United States Patent [19]

Westerkamp

[11] 4,397,238

[45] Aug. 9, 1983

[54] RECIPROCATING DOCTOR MECHANISM

[75] Inventor: Jürgen Westerkamp, Lengerich, Fed. Rep. of Germany

[73] Assignee: Windmöller & Hölscher, Lengerich of Westphalia, Fed. Rep. of Germany

[21] Appl. No.: 311,941

[22] Filed: Oct. 16, 1981

[30] Foreign Application Priority Data

Oct. 17, 1980 [DE] Fed. Rep. of Germany ..... 3039326

[51] Int. Cl.[3] ..... B41F 31/02; B21B 45/02

[52] U.S. Cl. ..... 101/367; 15/256.51

[58] Field of Search ..... 101/157, 169, 367, 363, 101/364, 348, 350, 347, 326, 148; 15/256.51, 256.5

[56] References Cited

U.S. PATENT DOCUMENTS

| | | | |
|---|---|---|---|
| 2,371,223 | 3/1945 | Crafts | 101/157 |
| 2,528,965 | 11/1950 | Meyer | 101/157 |
| 2,548,217 | 4/1951 | Huck et al. | 101/157 |
| 2,579,181 | 12/1951 | Faeber | 101/157 |
| 2,655,102 | 10/1953 | Ross | 101/364 X |
| 3,780,670 | 12/1973 | Abler et al. | 101/169 |
| 3,783,781 | 1/1974 | Grommek | 15/256.51 X |

FOREIGN PATENT DOCUMENTS

| | | | |
|---|---|---|---|
| 440773 | 1/1936 | United Kingdom | 101/157 |
| 440775 | 1/1936 | United Kingdom | 101/157 |
| 481035 | 3/1938 | United Kingdom | 101/157 |

*Primary Examiner*—E. H. Eickholt

*Attorney, Agent, or Firm*—Fleit, Jacobson & Cohn

[57] ABSTRACT

In a printing press where a doctor mounting is connected to a pivotable supporting member and the doctor is reciprocatable parallel to the plate cylinder axis, the doctor mounting is guided in a guide disposed on the supporting member and driven through an eccentric drive by an electric motor secured to the supporting member.

6 Claims, 4 Drawing Figures

RECIPROCATING DOCTOR MECHANISM

The invention relates to a doctor mechanism comprising a doctor for cooperating with a plate cylinder, a mounting which carries the doctor and is connected to a pivoted supporting member, and a drive for reciprocating the mounting on a guide which is parallel to the axis of the plate cylinder.

In a mechanism of this kind known from Auslegeschrift patent DE-AS No. 11 34 090, the supporting member is secured to a pivot shaft and the pivot shaft is provided with a drive which reciprocates same in its bearings in the axial direction.

DE-PS German patent No. 512 135 discloses a drive in the form of a piston-cylinder unit for reciprocating the doctor.

It is also known to pivot the supporting member and doctor mounting on a carriage which is displaceable in guides and which is provided with a piston-cylinder unit for pivoting the supporting member and a drive for reciprocating the supporting member.

The known mechanisms have the disadvantage that supporting members and bearing units of considerable weight must be reciprocated together with the doctor, so that the drives have to be correspondingly powerful and a fine adaptation of the doctor motion to the speed of the printing press is either completely impossible or involves increased expense.

It is difficult to operate the known doctors because the movement of the doctor into engagement with the associated plate cylinder can be performed only with difficulty and can hardly be performed in a reproducible manner.

For this reason it is an object of the invention to provide a simple mechanism for adjusting the doctor in height and for pivotally moving the doctor into and out of engagement with the plate cylinder.

It is another object of the invention to provide a doctor mechanism which comprises only small masses which are to be moved.

The first object is accomplished in accordance with the invention in that the carrying member is secured to the top end of a rod, which is longitudinally slidably guided in and adapted to be fixed in position in a guide member, and that the guide member is secured to a shaft, which is pivotally movable by a manually operable device. The rod may constitute a rack meshing with a pinion which is adapted to be driven by a handwheel.

According to a further feature of the invention, the doctor mounting is guided in a guide disposed on the supporting member and driven by an eccentric drive from an electric motor secured to the supporting member. In the mechanism according to the invention, only the doctor mounting with the doctor is reciprocated so that the masses to be moved together with the doctor are reduced to a minimum. Since the masses to be moved with the doctor can be kept low in the apparatus according to the invention and they exert only a small load on the drive, the drive can be a simple eccentric drive.

Since only a low driving power is required to drive the doctor according to the invention on account of the low moving masses, the driving motor can be a D.C. motor which facilitates simple and fine adjustment and adaptation of the doctor speed to the speed of the machine.

The guide for the doctor mounting desirably comprises a cross-roller carriage guide, the rails of which are connected to the supporting member and the carriage is connected to the doctor mounting. The known cross-roller carriage guide provides a guidance free from play for the carriage which runs with little friction on rollers and so that the doctor is precisely guided.

By reason of the required low driving power, the eccentric drive may comprise an elongated hole which is disposed in the doctor mounting transversely to the direction of motion thereof and in which there is guided a roller eccentrically connected to the motor shaft. To set doctor movements of different size, the eccentricity of the roller may be adjustable.

An example of the invention will now be described in more detail with reference to the drawing, wherein FIG. 1 is a front elevation of the doctor with doctor drive as well as securing means;

Figure 1:
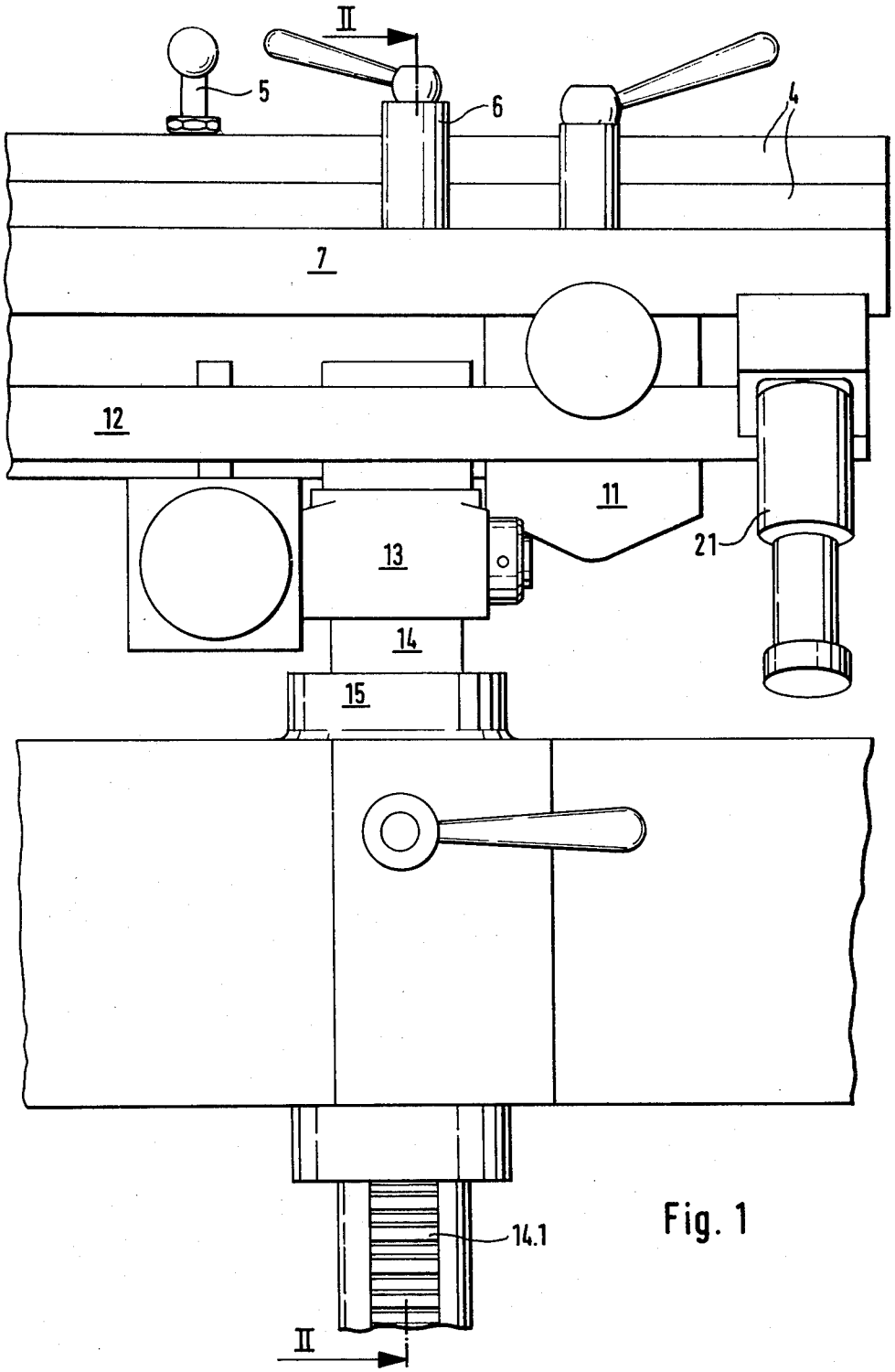
Figure 2:
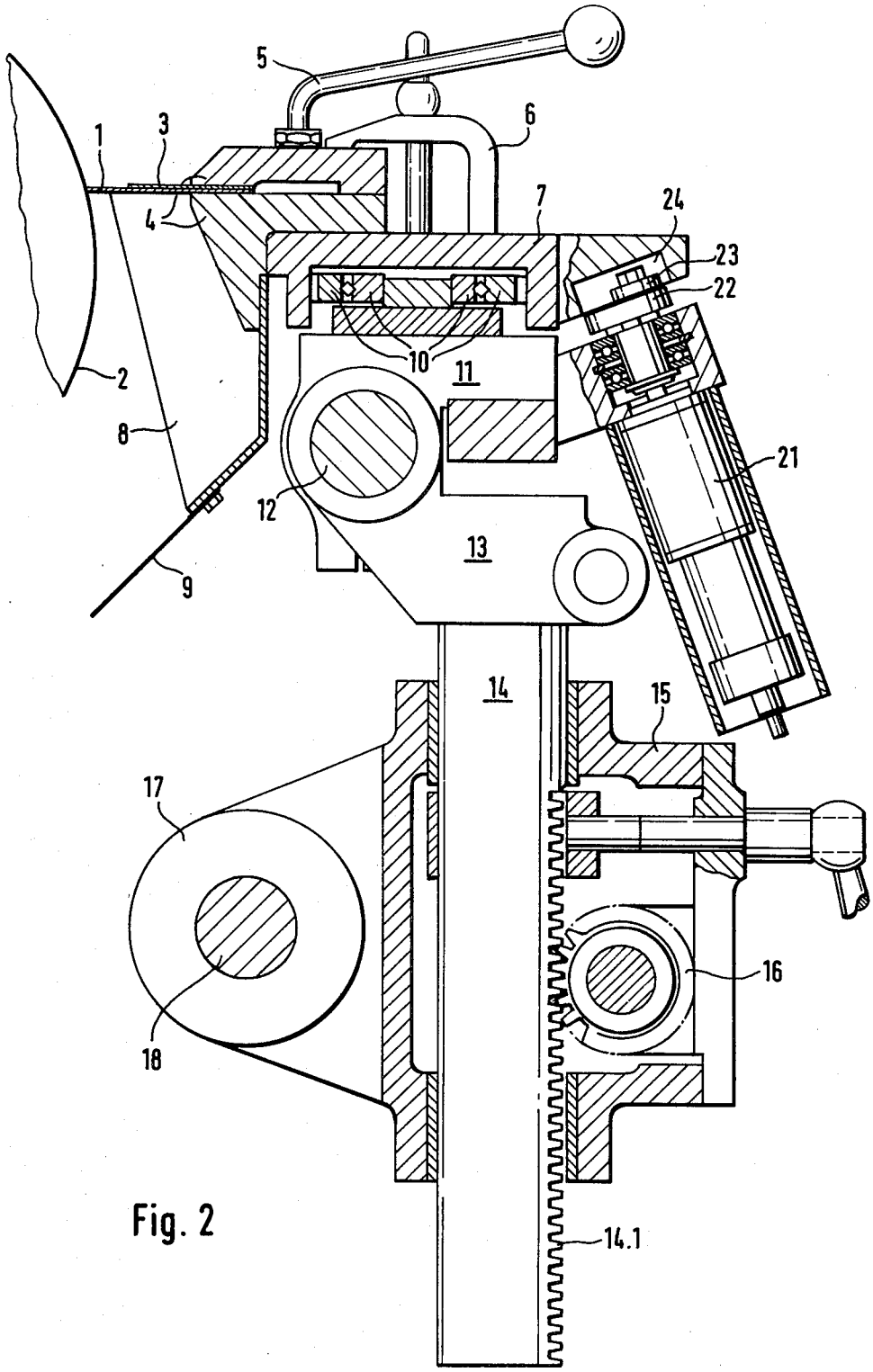
FIG. 2 is a section of the apparatus on the line II—II in FIG. 1.
Figure 3:
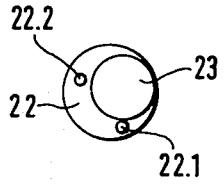
FIG. 3 is a plan view of the roller eccentrically secured on the motor shaft and FIG. 4 is an elevation of the eccentric drive consisting of an elongate hole and roller.
Figure 4:
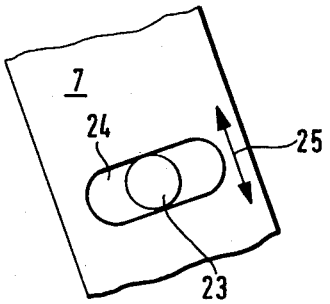

The doctor 1 is applied to the plate cylinder 2 in the manner shown in FIG. 2. By means of bolts 5 provided with handles, the doctor 1 together with a supporting doctor 3 is clamped into the doctor mounting 4. The doctor mounting 4 is connected to a supporting member 7 by claws 6.

The scraped-off ink is returned to an ink trough (not shown) by lateral splash plates 8 secured to the doctor mounting 4 and by guide plates 9.

The supporting member 7 is connected to the carriage of the cross-roller carriage guide 10 which, by way of rollers arranged in a cross, runs on guide rails secured on the supporting member 11.

The supporting member 11 is pivoted on the shaft 12 and can be secured in position thereon. The shaft 12 is fixed to a plummer block 13 clamped onto the rack 14. The rack 14 is mounted for longitudinal displacement in the guide member 15. The pinion 16 in mesh with the teeth 14.1 of the rack 14 can be driven by a handwheel (not shown), whereby to adjust the height of the doctor. By way of the mounting 17, the guide member 15 is fixed to the shaft 18 which, by means of worm gearing (not shown), can be turned about its shaft with the aid of a hand wheel so that the entire apparatus can be tilted away from the plate cylinder 2.

A D.C. gearing motor 21 secured on the supporting member 11 carries on its output shaft a disc 22 which is concentriclly mounted with respect to the axis of the output shaft. A roller 23 is eccentrically secured on the disc 22. The roller 23 is guided in an elongated hole consisting of a groove 24 formed in the supporting member 7. On rotation of the disc 22, the supporting member 7 is reciprocated in the direction of the double arrow 25. The disc 22 comprises a plurality of bores 22.1, 22.2 with different spacings from the axis of the output shaft of the gearing motor so that the roller 23 can be inserted therein with a variable eccentricity. By repositioning the roller 23 in different bores, different amplitudes can be achieved for the swing of the doctor.

What is claimed is:

1. A doctor mechanism for use with a plate cylinder comprising:

a doctor positionable so as to cooperate with a plate cylinder;

mounting means for carrying the doctor;

supporting means for supporting said mounting means;

guide means provided on said supporting means for guiding movement of said mounting means;

drive means for reciprocating said mounting means along said guide means, said guide means being adapted to be mounted so that it extends parallel to the axis of the plate cylinder;

a rod having an end thereof supporting said supporting means;

a guide member for longitudianlly slidably guiding movement of said rod and for fixing said rod in a desired position;

a shaft supporting said guide member so that said guide member is pivotally movable whereby movement of said guide member moves said doctor with respect to the plate cylinder, said rod having a rack-shaped portion; and a pinion meshing with said rack-shaped portion for longitudinally moving said rod.

2. A doctor mechanism comprising:

a doctor for cooperating with a plate cylinder;

a mounting carrying said doctor;

a pivotally supported supporting member for supporting and for guiding movement of said mounting in a direction extending parallel to the axis of the plate cylinder; and drive means for reciprocating the mounting with respect to said supporting member, said drive means comprising an electric motor secured on the supporting member and an eccentric drive driven by said motor.

3. A doctor mechanism according to claim 2, wherein said supporting member carries stationary rails of a cross-roller carriage guide for guiding movement of said mounting, the carriage of said cross-roller carriage guide being connected to said mounting carrying said doctor.

4. A doctor mechanism according to claim 2, wherein said eccentric drive comprises an elongated hole which extends in the mounting transversely to the direction of motion thereof, and a roller guided in said hole and eccentrically connected to a shaft of said motor.

5. A doctor mechanism according to claim 4, further comprising a disc connected to the shaft of said motor, said roller being secured to said disc.

6. A doctor mechanism according to claim 2, wherein the electric motor is a D.C. motor.

* * * * *